US005213664A

United States Patent [19]

Hansell

[11] Patent Number: 5,213,664

[45] Date of Patent: May 25, 1993

[54] LOTTERY TICKETS AND PAPER

[75] Inventor: Erik Hansell, Tyresö , Sweden

[73] Assignee: AB Tumba Bruk, Tumba, Sweden

[21] Appl. No.: 583,083

[22] Filed: Sep. 17, 1990

[30] Foreign Application Priority Data

Nov. 14, 1989 [SE] Sweden ..... 8903823

[51] Int. Cl.[5] ..... D21H 21/40

[52] U.S. Cl. ..... 162/134; 162/135; 162/140; 162/181.9; 283/903; 428/916

[58] Field of Search ..... 162/135, 138, 140, 181.9, 162/162, 134, 181.1, 181.5; 283/903

[56] References Cited

U.S. PATENT DOCUMENTS

| | | | |
|---|---|---|---|
| 2,328,198 | 8/1943 | Davenport et al. | 162/138 |
| 3,012,928 | 12/1961 | Whitman | 162/138 |
| 3,149,023 | 9/1964 | Bodendorf et al. | 162/138 |
| 3,758,376 | 9/1973 | Beckner et al. | 162/162 |
| 4,095,824 | 6/1978 | Bachman | 283/903 |
| 4,120,445 | 10/1978 | Carrier et al. | 283/903 |

FOREIGN PATENT DOCUMENTS

| | | | |
|---|---|---|---|
| 598964 | 11/1977 | Switzerland . | |
| 1435686 | 4/1972 | United Kingdom . | |
| 1387389 | 3/1975 | United Kingdom | 162/140 |
| 2122545 | 1/1984 | United Kingdom | 162/140 |

OTHER PUBLICATIONS

Casey, *Pulp and Paper,* vol. III and IV pp. 1739, 1740, 1854–1857, 1878, 1879, 2014–2018, 2518–2520.

*Primary Examiner*—Peter Chin

*Attorney, Agent, or Firm*—Banner, Birch, McKie & Beckett

[57] ABSTRACT

The invention relates to a new lottery ticket paper for the manufacture of different kinds of lottery tickets, especially of the "instant lottery ticket" type, and a method of manufacturing said tickets. The lottery ticket paper is characterized in that it comprises a coloured, opaque base paper coated on both sides with a composition comprising at least one pigment, a filler, a binder solution, and optionally viscosity regulating agents and some kind of security element. The lottery ticket paper is protected against see-through and various kinds of forgery. It is an environmentally pleasing, nonexpensive and from the production-technical point of view suitable alternative to existing foil-laminated lottery ticket papers.

11 Claims, No Drawings

LOTTERY TICKETS AND PAPER

The present invention relates to a new lottery ticket paper to be used in the manufacturing of lottery tickets, a method of manufacturing said lottery ticket paper, and to lottery tickets and a method of manufacturing said lottery tickets. The invention is especially concerned with a lottery ticket paper intended for lottery tickets such as, for example, so called instant lottery tickets.

Lottery tickets represent a special kind of security print which for reasons of security must be protected against see-through and various kinds of forgery.

The lottery tickets hitherto used and sold on the market are protected against see-through by being made from a foil-laminated paper material, usually an aluminium foil laminated to a stiff sheet of paper. The aluminium foil is printed with special printing inks which are volatile and/or require strong solvents. Said inks represent a potential hazard with respect to work environment as well as from a general environmental point of view. Also, the aluminium foil itself is extremely unsuitable from the environmental point of view, both in the manufacture of the foil-laminated sheet of paper itself and in taking care of the waste that is unavoidable in connection with printing and finishing of the product, as well as in destruction of the product after use.

Further, as a result of its sensitivity, the aluminium foil poses production-technical problems in the manufacture of aluminium foil laminated lottery tickets. Heavy demands are made as to printing accuracy, since if the foil is bent, folded or "cracked" during printing, the deformation will remain and the products have to be discarded.

From the forgery point of view, a multilayer product is unsuitable, since it may be delaminated and tampered with, for example by transferring information from one lottery ticket to another. Further, aluminium foil and sheets of paper are available on the market and can be used by forgers with knowledge of printing technique.

In the manufacture of lottery tickets it is of the utmost importance that it should be possible to check the number of lottery tickets made in a simple way. With existing equipment, aluminium foil laminated lottery tickets cannot be machine counted.

It is already known to use different types of coated paper for different applications mostly intended for the manufacture of paper with a bright and uniform quality. These coatings are usually very thin and, further, no suggestions have been made for the manufacture of instant lottery tickets by using a see-through protected base paper coated on both sides.

GB 1 435 686 discloses a security paper which is proof against alteration, especially abrasion of its surface. The paper comprises a paper base layer and an opaque abradable top coating of a contrasting appearance, so that alteration involving abrasion of the top coating can be visually detected. The paper base layer is preferably a dyed paper but neither the grammage nor the degree of transparency of the paper base layer is discussed. The only information about transparency is given in connection with the coating which is stated to be opaque, in the sense that it is opaque under normal conditions of illumination. The specification clarifies in more detail the meaning of opaque by stating that a one pound note is regarded as opaque. It is to be noted that according to the present invention by opaque is meant totally opaque, i.e. a conventional bank note would not be classified as opaque.

According to the present invention there is provided a new lottery ticket paper which is protected against see-through and which solves the above-mentioned problems connected with lottery ticket paper made from a foil-laminated paper material. The new tickets are protected against see-through, non-delaminatable, difficult to forge, and have a low grammage which gives low mailing expenses and facilitates storage of finished products. Further, the new tickets are nonexpensive to produce, congenial to the environment and suitable for printing, i.e. may be printed with conventional printing inks and conventional equipment, and may be machine counted using existing equipment.

Another object of the present invention is to suggest a method of manufacturing the new lottery ticket paper.

Yet another object of the invention is the manufacture of lottery tickets, especially so called instant lottery tickets.

The lottery ticket paper according to the invention is characterized in that it comprises a coloured, opaque base paper which is coated on both sides with a composition comprising at least one pigment, a filler, a binder solution, and optionally viscosity regulating agents. As an extra security feature, the coated paper may comprise some kind of security element, such as security chemicals, visible or non-visible fibres or a combination thereof.

The lottery ticket paper according to the invention comprises a coated base paper characterized in that the base paper is a coloured opaque base paper, which is coated on both sides with a nonfluorescent composition comprising at least one pigment, a filler, a binder solution, and optionally viscosity regulating agents. The coating is deposited on the paper to a density of 10–30 g dry solid matter per square meter of the coated side. Security elements in the form of security chemicals, visible or nonvisible fibers, and combinations thereof may be used if desired. In one embodiment, the base paper is colored with a light absorbing pigment, such as carbon black, and is covered on either side of the paper with a white pigment, such as titanium dioxide.

The base paper comprises a coloured, preferably black, cellulose containing paper or rag paper. By 'rag paper' is meant a paper containing textile. The base paper has a grammage of about 100 $g/m^2$–300 $g/m^2$ and is dyed with a coloured pigment, the origin of which may be either synthetic or organic, which makes the paper opaque. To attain an opaque paper, the base paper should be colored with a pigment, which both absorbs most of the incident light rays and especially is light-scattering. According to the invention, by opaque is meant totally opaque, i.e. it is impossible to see through the base paper even under intensive light. For example, the opacity of the base paper is non-measurable by conventional opacity measurement methods for paper, such as SCAN-P8. The base paper is preferably colored with a black pigment, such as carbon black.

The coloured paper is coated on both sides with a bright coating composition, which makes the surface of the paper suitable for printing, meaning that the paper may be printed using conventional printing techniques, such as ordinary offset printing and/or screen printing. The coating according to the invention is thin, however, compared to conventional coated paper represents a relatively thick coating.

The base paper is preferably coated with the coating composition to a grammage of the coating of between 10 g dry solid matter/$m^2$ of coated side and 30 g dry solid matter/$m^2$ of coated side, preferably 20 g–30 g and especially 20 g–25 g solid matter/$m^2$ of coated paper side. Pigments which may be used in the coating composition are preferably bright, non-fluorescent pigments, especially titanium dioxide or similar white pigments. Since the coating composition is preferably non-fluorescent, it is possible, when required, to use UV-fluorescent inks for the subsequent printing of the paper. By means of UV-fluorescent printing inks, it is easy to check the genuineness of the lottery tickets.

The filler is usually clay, kaolin, or other conventional filler used in the coating of paper. The binder may be, for example, latex, starch, or casein in a water-based solution. Alternatively, the binder solution may be a hot melt plastic.

For reasons of security, the lottery ticket paper may also comprise fibres which are visible or non-visible in daylight, or a combination thereof. Preferably, the fibres are UV-fluorescent fibres. The fibres may be included in the coating composition or laminated between the base paper and the coating. Fibres suitable for use in the lottery ticket paper according to the invention are fibres of synthetic or regenerated origin, e.g. polyamide, polyester or rayon fibres. Suitable fibres have a length of about 2–10 mm and preferably about 4–5 mm and a diameter of about 3–10 Dtex. A suitable amount of fibres in the coating is about 50–250 fibres/$dm^2$.

Further, the coating composition may contain a further security element such as one or more so called security chemicals, which make the coating unique and protect the lottery ticket paper as well as the products produced against possible forgery such as by erasure or alteration of the printed paper. Security chemicals to be mentioned are, for example, Securistain, Clorostain, Solvent Black and Nitrofast Blue (trademarks). These chemicals indicate visibly attempts at forgery and/or tampering. The chemicals are added in amounts which are sufficient to indicate such attempts. Suitable quantities of said chemicals are equivalent to an amount in the fully converted paper of around 80 l/ton of paper.

It is true that it is previously known to add various security elements to paper pulp used for the manufacture of security paper for various types of security print. It is, however, not previously known to include security elements in a coating intended for security print. It is therefore surprising and unexpected that according to the present invention there is provided a base paper coated on both sides, which without objections is usable for the manufacture of lottery tickets and which, from the security point of view, fulfills the special requirements as regards products of this kind.

In an alternative embodiment of the invention, the base paper may be fusion coated, for example flow coated with hot melt plastic instead of being coated with a water-based coating mixture.

Further, the invention relates to a method of manufacturing lottery ticket paper.

The lottery ticket paper according to the invention may be used for the manufacture of so called instant lottery tickets. The lottery ticket paper is printed on both sides with conventional printing inks or UV-fluorescent inks. One side of each ticket is printed with a figure combination which is unique for each lottery ticket. On the back of said ticket there is printed general information about the lottery in question, which information is the same on all tickets. The unique figure combination on the ticket is then covered with a coating comprising a conventional coloured latex solution. Such suitable latex solutions are well known and have been used, for example, on the conventional instant lottery tickets produced from foil-laminated paper material. After buying a ticket, the buyer rubs off the latex coating and is able to see directly whether he has won.

The use of the lottery ticket paper according to the invention is apparent from claims 9–10 and further an instant lottery ticket is stated in claim 11.

The invention will now be described in more detail by means of the following non-limiting examples.

EXAMPLE 1

Lottery ticket paper was prepared by applying a coating of around 20 g dry solid matter/$m^2$ and side of base paper to both sides of a base paper having a grammage of 225 g/$m^2$, inked with carbon black, which had been added to the stock preparation during the manufacture of the paper. The coating mixture comprised a water dispersion of clay, titanium dioxide, latex and optionally viscosity regulating agents. The coating mixture was applied on both sides of the base paper by conventional methods, which are well known to a person skilled in the art. The coated paper was then dried and glazed in the conventional way in the drying section of the machine.

EXAMPLE 2

Lottery ticket paper was prepared as described in Example 1, except that the coating composition further comprised the security chemicals Securistain, Clorostain, Solvent Black and Nitrofast Blue (trademarks) in an amount of 801/ton of paper.

EXAMPLE 3

Lottery ticket paper was prepared as described in Example 1, except that the coating composition further comprised polyamide fibres in an amount of about 125 fibres/$dm^2$ of paper.

The products produced in accordance with Examples 1–3 have a uniform, even, white surface on both sides. The coatings may be printed with conventional printing inks and conventional printing equipment. The coated base papers produced in accordance with Examples 1–3 cannot be delaminated, since the coatings consist of a deposited composition originating from various powdered components.

EXAMPLE 4

A lottery ticket, so called instant lottery ticket, was prepared using a lottery ticket paper produced in accordance with Example 1. The ticket paper was printed on both sides with conventional inks intended for offset printing. Alternatively, UV-fluorescent inks may be used. One side of the lottery ticket paper was printed in an offset machine with figure combinations which were unique of each lottery ticket. The back of the paper was provided with suitable printed information which was the same on all lottery tickets and which was related to the lottery in question. The figure combination of the lottery ticket was then covered by coating with a coloured latex solution.

The lottery ticket was tested by the National Swedish Laboratory of Forensic Science, Linköping, Sweden, and was found to fulfill the requirements for see-through protection and tamperproofness.

The products produced are machine countable. They are nonexpensive to manufacture and have a relatively low weight, so that mailing expenses will be low. They are suitable to the environment and are easily destroyed in connection with refuse disposal. This means that, like ordinary printing paper, the lottery ticket paper may easily be recycled.

I claim:

1. A paper useful for lottery tickets comprising: a base paper completely filled with carbon black in an amount sufficient to render said base paper black and completely opaque, said base paper exhibiting a weight of about 100–300 g/m$^2$; and a bright coating on either side of said base paper which makes the surfaces of the paper suitable for printing with conventional techniques, each coating comprising white pigment and 10–30 g. dry solids/m$^2$ per side;

printing exhibiting the form of a unique character combination of the surface of one coating; and a latex coating over said figure combination.

2. A paper according to claim 1 comprising 20–30 g. dry solids/m$^2$ per side.

3. A paper according to claim 2 comprising 20–25 g. dry solids/m$^2$ per side.

4. A paper according to claim 1 wherein said pigment is nonfluorescent.

5. A paper according to claim 4 wherein said pigment comprises titanium dioxide.

6. A paper according to claim 1 further comprising a binder layer which comprises a hot melt plastic.

7. A paper according to claim 1 wherein the coatings further comprise fibers that are visible on said paper under daylight or ultraviolet light.

8. A paper according to claim 7 wherein said fibers have a length of about 2–10 mm in an amount of 50–250 fibers/dm$^2$.

9. A paper according to claim 1 further comprising fibers between the coatings and said base layer that are visible through the coatings under daylight or ultraviolet light.

10. A paper according to claim 9 wherein said fibers have a length of about 2–10 mm in an amount of 50–250 fibers/dm$^2$.

11. A paper useful for lottery tickets comprising:

a base paper completely filled with carbon black in an amount sufficient to render said base paper black and completely opaque;

a bright coating on either side of said base paper which makes the surfaces of the paper suitable for printing with conventional techniques, wherein each said coating comprises a white pigment;

printing exhibiting the form of a unique character combination on the surface of one coated side; and a latex coating over said figure combination.

* * * * *